US007588021B2

(12) United States Patent
Lykowski

(10) Patent No.: US 7,588,021 B2
(45) Date of Patent: Sep. 15, 2009

(54) SPARK PLUG CIRCUIT

(75) Inventor: James D. Lykowski, Temperance, MI (US)

(73) Assignee: Federal-Mogul Worldwide, Inc, Southfield, MI (US)

( * ) Notice: Subject to any disclaimer, the term of this patent is extended or adjusted under 35 U.S.C. 154(b) by 110 days.

(21) Appl. No.: 11/735,705

(22) Filed: Apr. 16, 2007

(65) Prior Publication Data

US 2007/0240693 A1 Oct. 18, 2007

Related U.S. Application Data

(66) Substitute for application No. 60/792,205, filed on Apr. 14, 2006.

(51) Int. Cl.
*F02P 3/01* (2006.01)

(52) U.S. Cl. ..... 123/606; 123/169 R; 123/620

(58) Field of Classification Search ..... 123/169 R, 123/169 EL, 606–608, 620; 313/141
See application file for complete search history.

(56) References Cited

U.S. PATENT DOCUMENTS 3,599,616 A 8/1971 Oishi et al.
4,033,316 A * 7/1977 Birchenough ..... 123/598
4,349,008 A * 9/1982 Wainwright ..... 123/620
5,271,268 A * 12/1993 Ikeuchi et al. ..... 73/115
5,980,345 A 11/1999 Chang et al.
6,071,163 A 6/2000 Chang et al.
6,095,124 A 8/2000 Matsubara et al.
6,326,720 B1 12/2001 Ito
6,617,706 B2 9/2003 Matsubara et al.
6,653,767 B2 * 11/2003 Morita et al. ..... 313/141
7,267,116 B2 * 9/2007 Miwa et al. ..... 123/169 EL
2002/0167225 A1 11/2002 Matsubara et al.
2003/0076022 A1 4/2003 Moriya
2003/0116148 A1 6/2003 Sakakura
2003/0164165 A1 9/2003 Meinders

* cited by examiner

*Primary Examiner*—Stephen K Cronin
*Assistant Examiner*—J. Page Hufty
(74) *Attorney, Agent, or Firm*—Robert L. Stearns; Dickinson Wright, PLLC

(57) ABSTRACT

A spark plug circuit for, and a method of, reducing or preventing the corrosion of a spark plug electrodes in an internal combustion engine. The circuit and method provide a positive voltage across the center electrode/ground electrode gap, which repels positively charged corrosion mechanisms, such as calcium and phosphorus ions.

17 Claims, 3 Drawing Sheets

SPARK PLUG CIRCUIT

CROSS-REFERENCE TO RELATED APPLICATIONS

This application claims priority to U.S. Provisional Application Ser. No. 60/792,205, filed Apr. 14, 2006 which is hereby incorporated by reference.

BACKGROUND OF THE INVENTION

1. Technical Field

The present invention relates to spark plugs for igniting the fuel/air mixture in a combustion chamber of an automobile and to systems and methods for reducing corrosion, clogging and fouling of the center electrode of the spark plug.

2. Discussion

Spark plugs, of course, are well known in the automotive and other industries for igniting the fuel mixture in the cylinders of internal combustion engines. Spark plugs are exposed to extremely high temperatures and corrosive environments which reduce their useful life. In order to increase the useful life of the spark plug, and especially the discharge portion of the spark plug, many spark plugs use metals containing predominately Platinum (Pt), Iridium (Ir) or alloys thereof. Nonetheless, corrosion mechanisms are still present with spark plugs using Ir. The corrosion mechanism on spark plugs using Ir occurs through the presence of calcium and/or phosphorus, both of which are often present in the oil used to lubricate the engine, which invariably enters the combustion chamber in internal combustion engines. Due to the high temperature of the combustion reaction it has been found that calcium and phosphorous may wear away or corrode the Ir on the electrode of the spark plug. Other problems with Ir include severe oxidation at certain temperature ranges. Though the discharge portion of the spark surface is typically immune from wear, over time corrosion or oxidation may cause pieces of the discharge portion to dissolve, erode and/or vaporize. It is believed that calcium and/or phosphorus is the cause of this wear. The source of the calcium and phosphorus is from the lubricating oil that is circulated throughout the engine. A small amount of lubricating oil is present in the combustion chamber as it moves past the piston rings.

Engine designers and manufacturers are continually pressured to increase the efficiency of the engine. One major source of loss of efficiency is in the form of friction. Major friction losses occur through the reciprocal movement of the pistons within the combustion chambers. In an effort to reduce the friction between the pistons and combustion chamber walls, engine designers are changing the piston ring designs to reduce friction, which tends to allow more oil to pass between the piston and combustion chamber walls, thus leading to an increase of engine lubricant entering into the combustion chamber. This increase in engine lubricant into the combustion chamber increases corrosive compounds, such as calcium and phosphorus, and exacerbate the corrosion and fouling of the Ir containing electrodes.

Further, it has been observed that during the combustion cycle, calcium and phosphorus is present in ionic form in the gas phase of the combustion cycle. The gas containing the calcium and phosphorus molecules condenses into a liquid onto the tip of the Ir electrode. Because the calcium and phosphorus ions are positively charged, they are attracted to the negatively charged electrode of the spark plug. Once on the tip of the electrode, the corrosion mechanism of the calcium and phosphorus ions acts to corrode and/or foul the electrode. Moreover, it is known that molten calcium dissolves Ir and leaves the Ir electrode vulnerable to oxidation.

Therefore, there is a need for a new and improved method and system for preventing or reducing the corrosion mechanism caused by the presence of calcium and phosphorus in the combustion chamber.

SUMMARY OF THE INVENTION

In view of the above, the described features of the present invention generally relate to a spark plug ignition circuit for igniting the fuel/air mixture in a combustion chamber of an internal combustion engine. The circuit comprises a battery having a positive terminal and a negative terminal, which is connected to a vehicle ground. The circuit further includes an ignition circuit having a first and second switch terminal, which is operably connected to the vehicle ground. The circuit also comprises an ignition coil having a primary coil and a secondary coil, wherein the primary coil has a first coil end operably connected to the first switch terminal of the ignition circuit and a second coil end operably connected to the positive terminal of the battery. The secondary coil has a first coil end and a second coil end, which is operably connected to vehicle ground. Additionally, the circuit comprises a spark plug having a center electrode and a ground electrode, wherein the center electrode is operably connected to the first coil end of the secondary coil and the ground electrode is operably connected to ground, wherein the center electrode and the ground electrode are separated by a gap and the secondary coil provides a first positive voltage across the gap between the center electrode and the ground electrode.

In another embodiment of the present invention, a method for reducing corrosion of spark plug electrodes in an ignition system is disclosed. The method comprises the step of providing a first positive voltage across the gap between the center electrode and the ground electrode.

In yet another embodiment of the present invention, a spark plug ignition circuit for igniting the fuel/air mixture in a combustion chamber of an internal combustion engine is disclosed. The circuit comprises a battery having a positive terminal and a negative terminal, which is connected to a vehicle ground. The circuit further includes an ignition circuit having a first and second switch terminal, which is operably connected to the vehicle ground. The circuit also comprises an ignition coil having a primary coil and a secondary coil, wherein the primary coil has a first coil end operably connected to the first switch terminal of the ignition circuit and a second coil end operably connected to the positive terminal of the battery. The secondary coil has a first coil end and a second coil end, which is operably connected to vehicle ground. Additionally, the circuit comprises a spark plug having a center electrode and a ground electrode, wherein the center electrode is operably connected to the first coil end of the secondary coil, the ground electrode is operably connected to ground, and the ground electrode has a portion made of Iridium or an alloy of Iridium, wherein the center electrode and the ground electrode are separated by a gap and the secondary coil provides a negative voltage across the gap between the center electrode and the ground electrode.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION

Figure 1:
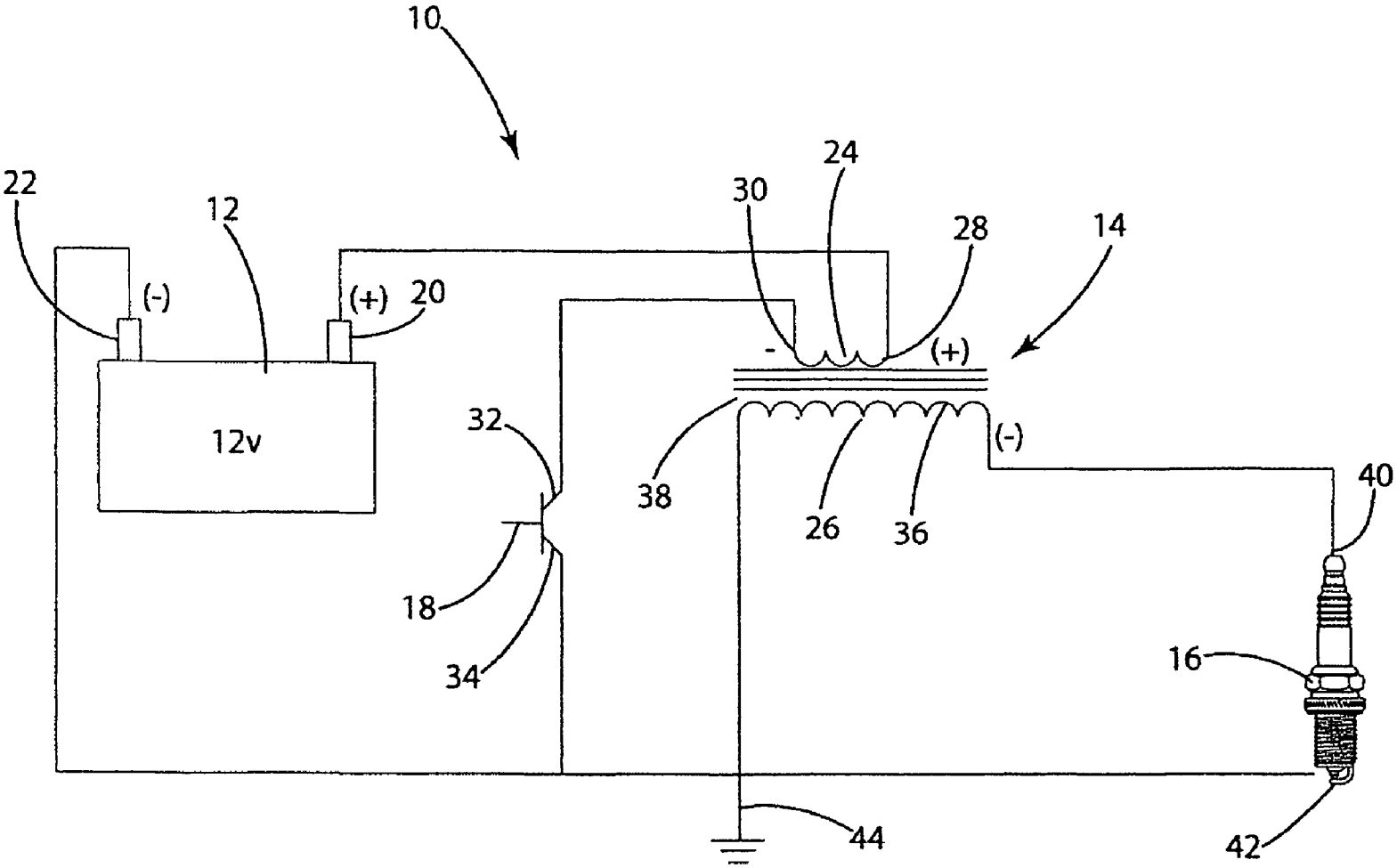
Fig. 1 (Prior Art)
FIG. 1 is a schematic diagram of a conventional automotive ignition system.

Referring now to FIG. 1, a conventional automotive ignition system is shown schematically. Prior art ignition circuit 10 generally includes a battery 12, an ignition coil 14, a spark plug 16, and an ignition switch 18. The battery 12 includes two terminals: positive terminal 20 and negative terminal 22. The ignition coil 14 includes a primary coil 24 and a secondary coil 26. Primary coil 24 has a first coil end 28 connected to the positive terminal 20 of battery 12. Primary coil 24 also has a second coil end 30 connected to switch 18. Switch 18 has a first switch terminal 32 and a second switch terminal 34. Connected to the second switch terminal 34 is negative terminal 22 of battery 12. Secondary coil 26 has a first end 36 connected to spark plug 16 and a second end 38 connected to negative terminal 22 of battery 12.

Spark plug 16 generally includes a first end 40 having an electrical connector for attaching, as is conventionally known, a distributor wire connecting the first end 36 of secondary coil 26 to spark plug 16. As is conventionally known, the electrical connector at the first spark plug end 40 is in communication with a center electrode, which is insulated from the grounded body of spark plug 16 at second spark plug end 42. Generally, second spark plug end 42 has a ground electrode and is connected through the engine and body of the vehicle to the vehicle ground or the negative terminal 22 of battery 12. Circuit 10 may have multiple grounding points, such as grounding point 44, which connect the circuit 10 to vehicle ground.

In operation, battery 12 energizes the primary coil 24 of ignition coil 14. Once the primary coil 24 is fully energized and the appropriate time in the combustion cycle is reached, that is, when a spark is required, switch 18 is activated to disconnect primary coil 24 from ground 44. Upon disconnection of the primary coil 24 from ground, the energy stored in primary coil 24 is released through a collapsing magnetic field. As the magnetic field collapses, voltage is induced in secondary coil 26. The polarity of the voltage induced in secondary coil 26 is dictated by polarity set up in primary coil 24. Secondary coil 26 will have the opposite polarity of primary coil 24. In other words, if the first end 28 of the primary coil 24 is the positive end, then the first end 36 of secondary coil 26 will be the negative end of secondary coil 26. If the first end 36 of secondary coil 26 is the negative end of secondary coil 26, which is the case for circuit 10 shown in FIG. 1, the electrode of spark plug 16 will be negatively charged with respect to ground 44. The second end 42 of spark plug 16 is connected to ground 44, which has a positive polarity with respect to first end 40, and the spark will be created between the negatively charged electrode and end 42 of spark plug 16.

Figure 2:
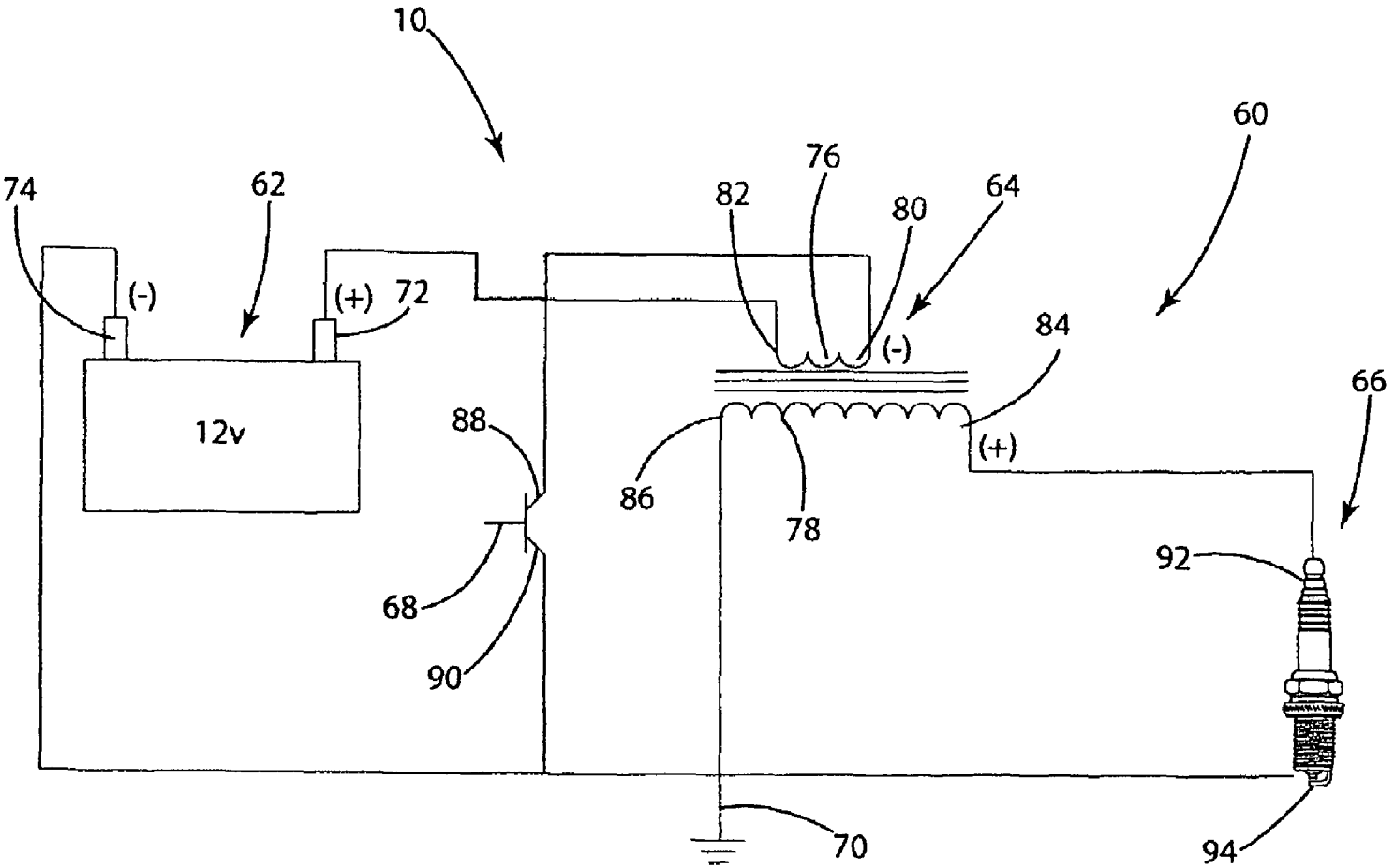
FIG. 2 is a schematic diagram of a spark plug ignition system, in accordance with one embodiment of the present invention.

Referring now to FIG. 2, a schematic diagram illustrating a spark plug ignition circuit 60 in accordance with one embodiment of the present invention is shown. Ignition circuit 60 includes a battery 62, an ignition coil 64, a spark plug 66, an ignition switch 68, and at least one ground point 70. Battery 62, as is conventionally known, has a positive terminal 72 and a negative terminal 74.

Ignition coil 64 includes a primary coil 76 and a secondary coil 78. Primary coil 76 has a first coil end 80 and a second coil end 82. First coil end 80 is connected to ignition switch 68, and second coil end 82 is connected to positive terminal 72 of battery 62. Secondary coil 78 has a first coil end 84 connected to spark plug 66 and a second coil end 86 connected to ground point 70. Ignition switch 68 has a first switch terminal 88 connected to the first end of primary coil 76 and a second switch terminal 90 connected to a negative terminal 74 of battery 62.

Spark plug 66 may have various configurations suitable for use in a variety of applications. The configuration of spark plug 66 shown in the Figures is for illustrative purposes only. The present invention contemplates the use of a variety of spark plug types and configurations, including spark plugs having a center electrode having an Ir or Ir alloy discharge portion. Spark plug 66 has a center electrode and a ground electrode 94. The center electrode is in communication with an electrical connector 92. Electrical connector 92 is configured to connect to an electrical cable (shown schematically) such as a distributor wire. The center electrode via electrical connector 92 of spark plug 66 is connected to first coil end 84 of secondary coil 78, and the ground electrode 94 of spark plug 66 is connected to ground point 70 or vehicle ground.

In operation, primary coil 76 of ignition coil 64 is energized by battery 62. The connections previously described with regard to the primary coil 76 of ignition coil 64 sets up a voltage polarity where the first end 80 of primary coil 76 is at vehicle ground and coil end 82 of primary coil 76 is at positive twelve volts or positive battery voltage. When a spark is required, which occurs at a specified time in the combustion cycle usually called spark timing, ignition switch 68 is opened to disconnect the first end 80 of primary coil 76 from vehicle ground. Once the vehicle ground connection of primary coil 76 is interrupted by switch 68, the magnetic field developed in primary coil 76 collapses, and the resulting change in magnetic flux induces a voltage across secondary coil 78. The polarity of voltage induced in coil 78 is the opposite of the polarity set up in primary coil 76. That is, first coil end 84 is at a positive voltage and second coil end 86 is at vehicle ground. When secondary coil 78 is fully charged, a spark is developed across the gap between the center electrode of spark plug 66 and the ground electrode 94. Since the first end 84 of secondary coil 78 is at a positive voltage, then the center electrode of spark plug 66 is positively charged, and the ground electrode 94 of spark plug 66 is at vehicle ground.

It has been observed that spark plugs having a portion of their center electrode made of an iridium or an alloy thereof enhances the life and durability of the discharge portion of the spark plug. Further, the inventor has determined that the combination of iridium and a positively charged electrode significantly reduces corrosion of the electrode. The corrosion mechanism is caused by the presence of calcium and phosphorus ions present in the combustion chamber. During combustion, the calcium and phosphorus ions are positively charged. The present invention, as described herein, provides a center electrode that is positively charged that, therefore, repels the positively charged calcium and phosphorus ions. Thus, the spark plug of the present invention is configured to significantly reduce or eliminate the impingement and/or collection of calcium and phosphorus ions on the center electrode. The inventor has also determined that, in a conventional spark plug ignition system in which a negative polarity is utilized as the sparking voltage, a reduction in corrosion of the spark plug can be achieved by utilizing an iridium or iridium alloy on the ground electrode only.

Figure 3:
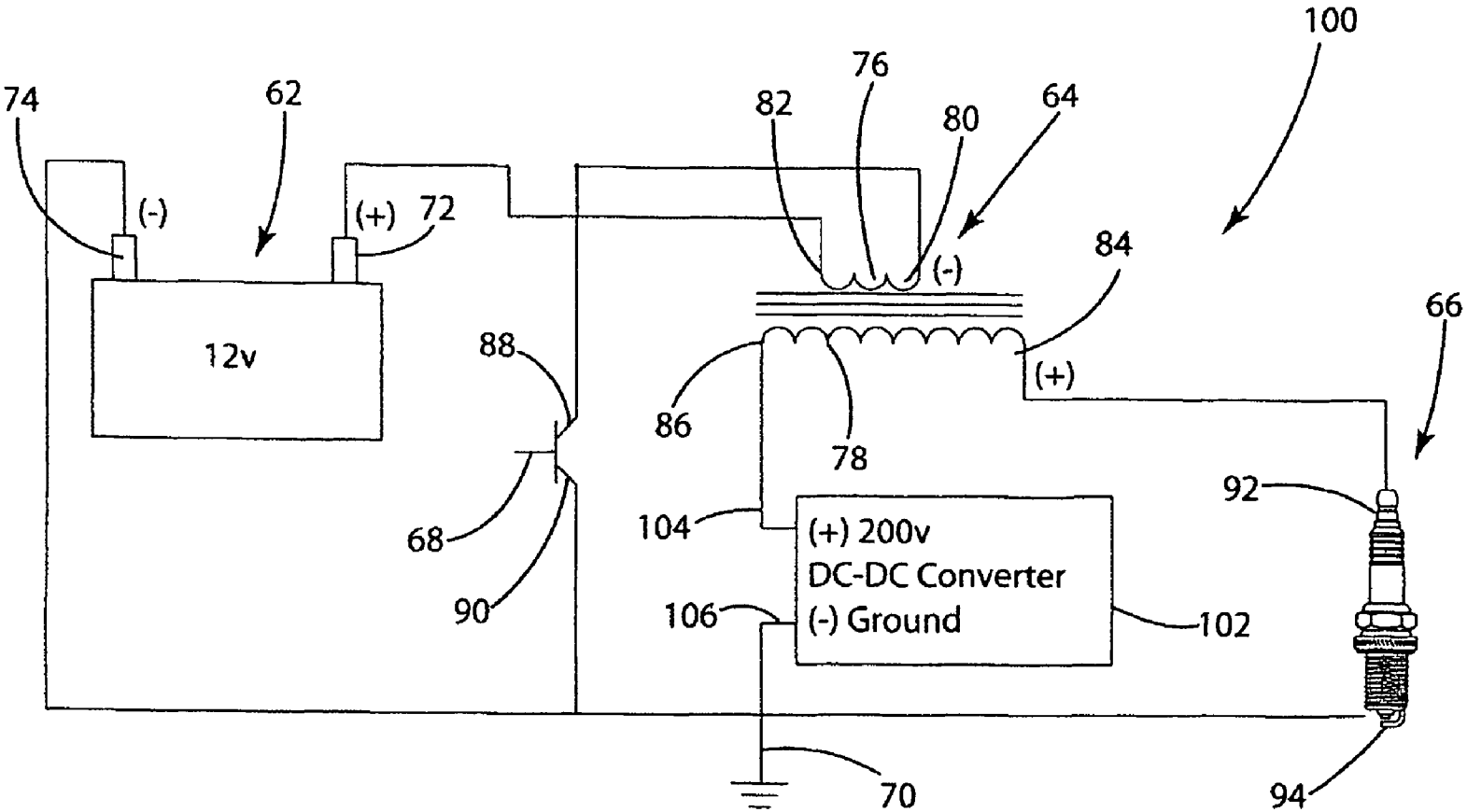
FIG. 3 is a schematic diagram of an alternate embodiment of a spark plug ignition system, in accordance with the present invention.

Referring now to FIG. 3, a schematic diagram of an alternate embodiment 100 of an ignition circuit, in accordance with the present invention, is illustrated. Ignition circuit 100 shown in FIG. 3 includes the same components as shown and described above with respect to FIG. 2 and includes the same connections to those components. However, alternate ignition circuit 100 includes a voltage source, illustrated in FIG. 3 as DC to DC converter 102. The DC to DC converter 102 provides a voltage source that will energize secondary coil 78 and provide a voltage across the gap of spark plug 66. While the embodiment illustrated in FIG. 3 includes DC to DC converter 102, the present invention contemplates the use of any secondary voltage source to provide this constant voltage, e.g., a capacitor or battery. The DC to DC converter 102 has a first terminal 104 and a second terminal 106. First terminal 104 of converter 102 is connected to the second end 86 of secondary coil 78. Second terminal 106 of DC to DC converter 102 is connected to ground point 70. Thus, converter 102 provides a constant positive voltage drop across the electrodes of spark plug 66 throughout the combustion cycle. Advantageously, the application of converter 102 provides a positive charge on the center electrode of spark plug 66 over the duration of the combustion cycle, thereby repelling the positively charged corrosive elements throughout the combustion cycle. Of course, the present invention contemplates the activation of DC to DC converter 102 over a time less than the entire combustion cycle as well.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A spark plug ignition circuit for igniting the fuel/air mixture in a combustion chamber of an internal combustion engine, comprising:

a battery having a positive terminal and a negative terminal, wherein the negative terminal is operably connected to a vehicle ground;

an ignition circuit having a first and second switch terminal, wherein the second switch terminal is operably connected to the vehicle ground;

an ignition coil having a primary coil and a secondary coil, wherein the primary coil has a first primary coil end and a second primary coil end, wherein the first primary coil end is operably connected to the first switch terminal of the ignition circuit and the second primary coil end is operably connected to the positive terminal of the battery and the secondary coil has a first secondary coil end and a second secondary coil end, wherein the second secondary coil end is operably connected to the vehicle ground;

a spark plug having a center electrode and a ground electrode, wherein the center electrode comprises Iridium and is operably connected to the first secondary coil end, and the ground electrode is operably connected to the vehicle ground, wherein the center electrode and the ground electrode are separated by a gap and the secondary coil provides a first positive voltage at the center electrode with respect to the ground electrode, across the gap; and a voltage source connected to the secondary coil to provide a second positive voltage at the center electrode with respect to the ground electrode, across the gap.

2. The spark plug ignition circuit of claim 1, wherein the center electrode has a portion made substantially entirely of Iridium.

3. The spark plug ignition circuit of claim 1, wherein the center electrode has a portion made of an alloy of Iridium.

4. The spark plug ignition circuit of claim 1, wherein the secondary coil provides the first positive voltage at the center electrode with respect to the ground electrode at spark timing.

5. The spark plug ignition circuit of claim 4, wherein the voltage source provides the second positive voltage at the center electrode with respect to the ground electrode at a time other than spark timing.

6. A method for reducing corrosion of spark plug electrodes in an ignition system, the ignition system comprising a battery having a positive terminal and a negative terminal, wherein the negative terminal is operably connected to a vehicle ground; an ignition circuit having a first and second switch terminal, wherein the second switch terminal is operably connected to the vehicle ground; an ignition coil having a primary coil and a secondary coil, wherein the primary coil has a first primary coil end and a second primary coil end, wherein the first primary coil end is operably connected to the first switch terminal of the ignition circuit and the second primary coil end is operably connected to the positive terminal of the battery and the secondary coil has a first secondary coil end and a second secondary coil end, wherein the second secondary coil end is operably connected to the vehicle ground; a spark plug having a center electrode and a ground electrode, wherein the center electrode comprises Iridium and is operably connected to the first secondary coil end, and the ground electrode is operably connected to the vehicle ground, wherein the center electrode and the ground electrode are separated by a gap; and a voltage source connected to the secondary coil, the method comprising the step of:

providing a first positive voltage from the secondary coil at the center electrode with respect to the ground electrode, across the gap; and providing a second positive voltage from the voltage source at the center electrode with respect to the ground electrode, across the gap.

7. The method of claim 6, wherein the step of providing the first positive voltage from the secondary coil at the center electrode with respect to the ground electrode is performed at spark timing.

8. The method of claim 6, wherein the step of providing the second positive voltage from the voltage source at the center electrode with respect to the ground electrode is performed at a time other than spark timing.

9. The method of claim 6, wherein the center electrode has a portion made substantially entirely of Iridium.

10. The method of claim 6, wherein the center electrode has a portion made of an alloy of Iridium.

11. A method for reducing corrosion of spark plug electrodes, comprising:

providing a battery having a positive terminal and a negative terminal, wherein the negative terminal is operably connected to a vehicle ground;

providing an ignition circuit having a first and second switch terminal, wherein the second switch terminal is operably connected to the vehicle ground;

providing an ignition coil having a primary coil and a secondary coil, wherein the primary coil has a first primary coil end and a second primary coil end, wherein the first primary coil end is operably connected to the first switch terminal of the ignition circuit and the second primary coil end is operably connected to the positive terminal of the battery and the secondary coil has a first secondary coil end and a second secondary coil end, wherein the second secondary coil end is operably connected to the vehicle ground;

providing a spark plug having a center electrode and a ground electrode, wherein the center electrode comprises Iridium and is operably connected to the first secondary coil end and the ground electrode is operably connected to the vehicle ground, wherein the center electrode and the ground electrode are separated by a gap;

providing voltage source connected to the secondary coil;

providing a first positive voltage from the secondary coil at the center electrode with respect to the ground electrode, across the gap; and providing a second positive voltage from the voltage source at the center electrode with respect to the round electrode, across the gap.

12. The method of claim 11, wherein the step of providing the first positive voltage from the secondary coil at the center electrode with respect to the ground electrode is performed at spark timing.

13. The method of claim 11, wherein the step of providing the second positive voltage from the voltage source at the center electrode with respect to the ground electrode is performed at a time other than spark timing.

14. The method of claim 11, wherein the center electrode has a portion made substantially entirely of Iridium.

15. The method of claim 11, wherein the center electrode has a portion made of an alloy of Iridium.

16. A spark plug ignition circuit for igniting the fuel/air mixture in a combustion chamber of an internal combustion engine, comprising:

a battery having a positive terminal and a negative terminal, wherein the negative terminal is operably connected to a vehicle ground;

an ignition circuit having a first and second switch terminal, wherein the second switch terminal is operably connected to the vehicle ground;

an ignition coil having a primary coil and a secondary coil, wherein the primary coil has a first primary coil end and a second primary coil end, wherein the first primary coil end is operably connected to the first switch terminal of the ignition circuit and the second primary coil end is operably connected to the positive terminal of the battery and the secondary coil has a first secondary coil end and a second secondary coil end, wherein the second secondary coil end is operably connected to the vehicle ground;

a spark plug having a center electrode and a ground electrode, wherein the center electrode is operably connected to the first secondary coil end, the ground electrode is operably connected to the vehicle ground, and the ground electrode has a portion comprising Iridium, wherein the center electrode and the ground electrode are separated by a gap and the secondary coil provides negative voltage at the center electrode with respect to the ground electrode, across the gap; and a voltage source connected to the secondary coil to provide a second negative voltage at the center electrode with respect to the round electrode, across the gap.

17. A spark plug ignition circuit for igniting the fuel/air mixture in a combustion chamber of an internal combustion engine, comprising:

a battery having a positive terminal and a negative terminal, wherein the negative terminal is operably connected to a vehicle ground;

an ignition circuit having a first and second switch terminal, wherein the second switch terminal is operably connected to the vehicle ground;

an ignition coil having a primary coil and a secondary coil, wherein the primary coil has a first primary coil end and a second primary coil end, wherein the first primary coil end is operably connected to the first switch terminal of the ignition circuit and the second primary coil end is operably connected to the positive terminal of the battery and the secondary coil has a first secondary coil end and a second secondary coil end, wherein the second secondary coil end is operably connected to the vehicle ground;

a spark plug having a center electrode and a ground electrode, wherein the center electrode is operably connected to the first secondary coil end, the ground electrode is operably connected to the vehicle ground, and the ground electrode has a portion made of an alloy of Iridium, wherein the center electrode and the ground electrode are separated by a gap and the secondary coil provides negative voltage at the center electrode with respect to the ground electrode, across the gap; and a voltage source connected to the secondary coil to provide a second negative voltage at the center electrode with respect to the round electrode, across the gap.

* * * * *